US010625989B2

(12) United States Patent
Klapper

(10) Patent No.: US 10,625,989 B2
(45) Date of Patent: Apr. 21, 2020

(54) HOLLOW PROFILE

(71) Applicant: Hans Künz GmbH, Hard (AT)

(72) Inventor: Georg Klapper, Hard (AT)

(73) Assignee: HANS KUNZ GMBH, Hard (AT)

( * ) Notice: Subject to any disclaimer, the term of this patent is extended or adjusted under 35 U.S.C. 154(b) by 0 days.

(21) Appl. No.: 15/793,328

(22) Filed: Oct. 25, 2017

(65) Prior Publication Data

US 2018/0134526 A1 May 17, 2018

(30) Foreign Application Priority Data

Nov. 17, 2016 (AT) ..... A 526/2016

(51) Int. Cl.

| | |
|---|---|
| ***B66C 6/00*** | (2006.01) |
| ***E04C 3/07*** | (2006.01) |
| ***E04H 12/20*** | (2006.01) |
| ***B66C 7/08*** | (2006.01) |
| *E04C 3/04* | (2006.01) |
| *E01D 101/30* | (2006.01) |
| *E04B 1/24* | (2006.01) |

(52) U.S. Cl.

CPC ..... *B66C 6/00* (2013.01); *B66C 7/08* (2013.01); *E04C 3/07* (2013.01); *E04H 12/20* (2013.01); *E01D 2101/30* (2013.01); *E04B 2001/2496* (2013.01); *E04C 2003/0434* (2013.01); *E04C 2003/0439* (2013.01); *E04C 2003/0456* (2013.01); *E04C 2003/0465* (2013.01)

(58) Field of Classification Search

CPC ..... B66C 6/00; E04C 3/07; E04C 2003/0465; E04C 2003/0456; E04C 2003/0439; E01D 2101/30

USPC ..... 238/26

See application file for complete search history.

(56) References Cited

U.S. PATENT DOCUMENTS

| | | | | |
|---|---|---|---|---|
| 1,046,347 A * | 12/1912 | Terrel | E01B 3/22 | 238/26 |
| 5,304,023 A * | 4/1994 | Toback | F16B 33/004 | 411/387.3 |
| 5,744,197 A * | 4/1998 | Van Eck | C10M 169/00 | 427/328 |
| 6,557,775 B1 * | 5/2003 | Brinson | E01B 23/02 | 238/10 R |
| 7,770,810 B2 * | 8/2010 | Kennard | E01B 23/02 | 238/10 R |

FOREIGN PATENT DOCUMENTS

| | | |
|---|---|---|
| DE | 1948467 | 10/1966 |
| DE | 1248256 | 8/1967 |
| FR | 1123262 | 9/1956 |

* cited by examiner

*Primary Examiner* — Patrick J Maestri

(74) *Attorney, Agent, or Firm* — Volpe and Koenig, P.C.

(57) ABSTRACT

A hollow profile (1, 15), in particular crane girder for a crane (14), wherein the hollow profile (1, 15) has a cavity (2) and an outer wall (3) bounding the cavity (2), and at least one fastening element (4) protruding from the outer wall (3) for the, preferably re-releasable, fastening of at least one add-on part (5) to the hollow profile (1, 15), wherein the outer wall (3) has at least one passage opening (6), which opens into the cavity (2), for the fastening element (4), and an intermediate space between that portion (36) of the outer wall (3) which bounds the passage opening (6) and the fastening element (4) which is guided through the passage opening (6) is sealed with a sealing compound (7).

20 Claims, 4 Drawing Sheets

HOLLOW PROFILE

INCORPORATION BY REFERENCE

The following documents are incorporated herein by reference as if fully set forth: Austrian Patent Application No. A 526/2016, filed Nov. 17, 2016.

BACKGROUND

The present invention relates to a hollow profile, in particular crane girder for a crane, wherein the hollow profile has a cavity and an outer wall bounding the cavity, and at least one fastening element protruding from the outer wall for the, preferably re-releasable, fastening of at least one add-on part to the hollow profile. Furthermore, the invention relates to a crane with at least one hollow profile, and to a method for fastening an add-on part to a hollow profile.

Hollow profiles are frequently used in steel construction, in particular in the construction of cranes. An example for hollow profiles used in cranes is crane girders which are generally designed as a hollow profile in what is referred to as a box structure. The hollow profile has a cavity and an outer wall surrounding said cavity. The outer walls are generally comprised of flat or curved metal sheets which are welded to one another.

In order to prevent water from accumulating, in particular due to precipitation, in the cavity and to prevent corrosion of the outer walls starting from the cavity, hollow profiles are generally tightly welded. That is to say, the cavity of the hollow profile is sealed in relation to the surroundings or the atmosphere, and therefore water cannot penetrate the cavity.

In order to fasten add-on parts, for example running rails, ladders, etc., to the hollow profile, fastening elements are frequently welded to the outer side of the outer wall of the hollow profile. This has the advantage that the tightness of the hollow profile can be ensured in the operating state.

FIG. 1 shows an embodiment, known from the prior art, of the fastening of an add-on part 5 (in the form of a running rail for a trolley of a crane) to a hollow profile. Only one portion of the closed hollow profile 1 is illustrated. The fastening elements 4 (=welded rail clamps) protruding from the outer wall 3 are connected in an integrally bonded manner to the outer wall 3 by weld seams 29. By tightening a nut 22, the rail clamp 13 is pressed against the rail foot of the running rail in the operating state in order to clamp the add-on part 5. The mathematical determination of the strength of a component under dynamic stressing is decisively determined by the notch events which occur. Notches which are caused, for example, by the weld seams 29 have scarcely any effect on the stressability of a component in the event of static, i.e. predominantly resting, stressing. In the event of dynamic, i.e. predominantly non-resting, stressing (for example due to position-changeable loads of a trolley of a crane), notches can lead to cracking and to a progressive cross-sectional weakening of the hollow profile. In order nevertheless to be able to verify a sufficient strength of the hollow profile mathematically, structural measures, such as, for example, relatively great wall thicknesses in the region of the load introduction points, are necessary. The dead weight of the hollow profile and the driving power required for operating the crane increase as a result.

SUMMARY

It is the object of the invention to provide an advantageous hollow profile of the type mentioned at the beginning which can have a sealed cavity and a lower dead weight.

This is achieved by a hollow profile with one or more features of the invention.

In the case of the hollow profile according to the invention, it is provided that the outer wall has at least one passage opening, which opens into the cavity, for the fastening element, and an intermediate space between that portion of the outer wall which bounds the passage opening and the fastening element which is guided through the passage opening is sealed with a sealing compound.

By providing a passage opening, which opens into the cavity, for the fastening element, a substantially more favorable notch situation can be achieved in comparison to welded-on fastening elements with the mathematical verification of the strength of the hollow profile. As a result, the material thickness of the hollow profile according to the invention can be reduced in comparison to the prior art and therefore a hollow profile with a comparatively low dead weight can be provided.

By sealing the intermediate space between that portion of the outer wall which bounds the passage opening and the fastening element with a sealing compound, the hollow profile is sealed in the region of the fastening element. There is therefore no pathway for fluid between the cavity and the atmosphere. Corrosion due to fluid entering the cavity in the interior of the hollow profile can therefore be prevented. The cavity of the hollow profile is advantageously completely separated from the atmosphere.

That portion of the outer wall which bounds the passage opening is advantageously designed in the form of a cylindrical casing.

Within the context of this document, a sealing compound is understood as meaning a, preferably cross-linkable or crosslinked, sealing compound which is applied to a surface, for example of the fastening element or to that portion of the outer wall which bounds the passage opening. During the application, the sealing compound is substantially unsolidified and, after the fastening element is introduced into the passage opening, enters into an adhesive connection with that portion of the outer wall which bounds the passage opening and with the fastening element. That is to say, the sealing compound adheres, preferably by a binding process (=crosslinking), to the surface of the passage opening and the surface of the fastening element by chemical and/or physical interaction and at the same time seals the intermediate space. In the event of crosslinking, a multiplicity of macro molecules arise which are linked to form a three-dimensional network which, in the crosslinked state, defines the physical properties of the sealing compound in the operating state of the hollow profile. The sealing compound could also be referred to as a sealant or sealing substance.

The sealing compound can be rigid or else elastic in the crosslinked and/or already hardened state In particular, it is conceivable and possible for the sealing compound to be an elastomer, for example silicone.

The at least one fastening element advantageously serves for the re-releasable fastening of at least one add-on part, preferably on the outside of the hollow profile. The add-on part can therefore be removed again from the hollow profile, preferably without being destroyed. As a result, add-on parts which are subjected to wear, such as, for example, running rails, can be rapidly exchanged. For this purpose, the fastening element can interact with further components, such as clamps, nuts, etc.

In a preferred embodiment, the fastening element has a head which is arranged in the cavity of the hollow profile and is supported on the inner surface of the outer wall, said inner surface facing the cavity. The head preferably has a larger diameter than the passage opening. In other words, the fastening element having a head is then held on the hollow profile in a form-fitting manner with respect to a direction pointing from the cavity to the atmosphere, as seen along the longitudinal extent of the passage opening. By the supporting of the fastening element on the inner surface of the outer wall via the head, large forces can be applied to the hollow profile by the fastening element. Furthermore, the add-on part can be fastened to the hollow profile with a large fastening force.

It is particularly preferably provided that the fastening element can be pretensioned for fastening the add-on part. Large clamping forces can thereby be applied for securely holding the add-on part on the hollow profile, in particular in the event of dynamic stressing of the add-on part.

In a preferred embodiment according to the invention, it is provided that sealing compound is additionally arranged between the head of the fastening element and the inner surface of the outer wall. The tightness between the fastening element and the outer wall of the hollow profile can thereby be increased.

In a preferred embodiment according to the invention, it is provided that the fastening element is a screw. The threaded portion of a screw enables the add-on part to be braced against or fastened to the hollow profile, for example by a nut.

It can be provided that a portion of a stem of the screw is located in the region of the passage opening in the operating state of the hollow profile, wherein the sealing compound is arranged between the stem and that portion of the outer wall which bounds the passage opening. Within the context of this document, the smooth, cylinder-jacket-shaped portion of a screw which adjoins the threaded portion of the screw in the direction of the head, but itself does not have a thread, is referred to as the stem.

However, it is also conceivable to use screws having a threaded portion extending substantially from one end of the screw toward the head as the fastening element. The screw then does not have a stem. In this case, it is conceivable and possible for at least one partial portion of the threaded portion to be located in the region of the passage opening in the operating state of the hollow profile, wherein the sealing substance is arranged between this threaded portion and that portion of the outer wall (=intermediate space) which bounds the passage opening. When screws with a short stem are used, the sealing compound could be arranged between the stem and the adjoining threaded portion and that portion of the outer wall which bounds the passage opening.

A fastening element which is designed as a screw can have any head, for example a hexagon head, square head, cylinder head, etc.

The screw is particularly preferably a shoulder bolt. Shoulder bolts have a stem which has a larger diameter than the threaded portion adjacent to the stem. The stem of shoulder bolts also has a larger stem diameter in comparison to other designs of conventional screws having an identical threaded diameter. As a result, shoulder bolts are particularly suitable for transmitting large transverse and longitudinal forces, i.e. transversely or longitudinally with respect to the longitudinal extent of the shoulder bolt.

In an alternative embodiment according to the invention, it can be provided that the fastening element is a bolt preferably having a threaded portion. The bolt can in turn have a head. However, it is also possible for the bolt not to have a head.

In one possible embodiment, it is conceivable for the bolt to have an opening through which a wedge can be knocked or driven in order to clamp the add-on part to the hollow profile.

It is particularly preferably provided that the sealing compound is a, preferably curing or cured, adhesive. Adhesives for connecting metal parts are well known. In addition to the sealing of the intermediate space, an adhesive furthermore permits the joining parts, i.e. the fastening element and the outer wall, to be fixedly connected to each other by surface adhesion (=adhesion) and the internal strength of the adhesive (=cohesion), preferably in the cured state of the adhesive. It can be provided that the adhesive absorbs at least part of the counter torque for pretensioning the fastening element. It is particularly preferred if the adhesive absorbs the entire counter torque for pretensioning the fastening element. The adhesive thereby prevents the fastening element from rotating during fastening of the add-on part to the fastening element.

It can be provided that the adhesive cures anaerobically. In the case of anaerobic curing, the adhesive cures with oxygen being excluded between closely adjacent metal surfaces, i.e. in the presence of metal ions. An example of a suitable adhesive is urethane methacrylate which cures anaerobically. However, instead of an anaerobically curing adhesive, other suitable adhesives which have a sufficient compression shear strength in the cured or crosslinked state could also be used.

The adhesive advantageously has a compression shear strength of more than 15 $N/mm^2$, particularly preferably of more than 25 $N/mm^2$. The compression shear strength is determined here in accordance with ISO 10123:2013 for a shaft and hub made from steel during a curing period of 7 days at 22° C.

The intermediate space between that portion of the outer wall which bounds the passage opening and the fastening element is preferably designed as an annular gap, wherein a gap width of the annular gap is between 0.01 mm and 0.15 mm, preferably between 0.02 mm and 0.1 mm, at least over the predominant part of the length of the annular gap. The annular gap can be in the form of a circular-cylindrical ring. This is the case in particular if the fastening element has a smooth stem and the latter lies opposite that portion of the outer wall which bounds the passage opening. However, the annular gap could also have a different shape and, for example, could have a spiral inner circumferential surface, as can be the case with a fastening element threaded portion arranged in the passage opening.

In a preferred embodiment, it is provided that the sealing compound fills the annular gap, preferably completely. In other words, it is advantageous if the sealing compound fills the entire intermediate space between that portion of the outer wall which bounds the passage opening and the fastening element.

It can furthermore be provided that the outer wall and a fastening element portion protruding from the outer wall in the operating state are coated with an anti-corrosion layer. The coating here is preferably applied to the outer side of the hollow profile, the outer side pointing away from the cavity.

The invention furthermore provides a crane, in particular a gantry crane or a bridge crane, which, in particular as a crane girder, has at least one hollow profile according to the invention. The at least one hollow profile can be used as a structural component, i.e. a load-bearing component of the crane.

The at least one add-on part is preferably a running rail of the crane for at least one running wheel of a trolley of a hoist of the crane. The hollow profile advantageously has a multiplicity of fastening elements, wherein, in the operating state, the running rail is fastened to the fastening elements, preferably by rail clamps. The running rail could also be referred to as a crane rail for the trolley. In other applications, the add-on part which is fastenable to the hollow profile could be a ladder, bracket or the like.

Furthermore, a method according to the invention for fastening an add-on part, in particular a running rail, to a hollow profile according to the invention is provided. The sealing compound is applied to that portion of the outer wall which bounds the passage opening or to the fastening element. The fastening element is subsequently introduced into the passage opening, wherein the intermediate space between that portion of the outer wall which bounds the passage opening and the fastening element is sealed with the sealing compound, and the add-on part, in particular after the crosslinking of the sealing compound, is fastened to the hollow profile by the fastening element.

It can be provided that the threaded portion is covered before the fastening element is introduced, in order to prevent soiling of the threaded portion with sealing compound, in particular adhesive.

The passage opening could be introduced into the outer wall of the hollow profile, for example by drilling a through-hole.

It can furthermore be provided that the outer wall and a portion of the fastening element that protrudes from the outer wall in the operating state are coated with an anti-corrosion layer after the sealing compound has cured. The anti-corrosion layer here is applied to the outer side of the outer wall and only after the fastening elements are fastened in the passage openings.

BRIEF DESCRIPTION OF THE DRAWINGS

Further features and details of preferred embodiments of the invention are illustrated in the form of different variants in the given illustrations, in which.

DETAILED DESCRIPTION OF THE PREFERRED EMBODIMENTS

Figure 1:
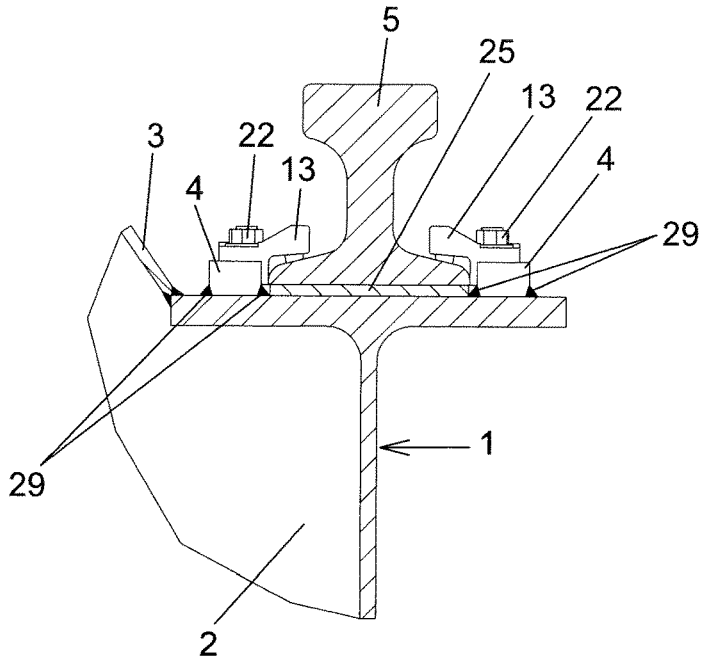
FIG. 1 shows an illustration of a hollow profile according to the prior art with welded-on fastening elements.
Figure 2:
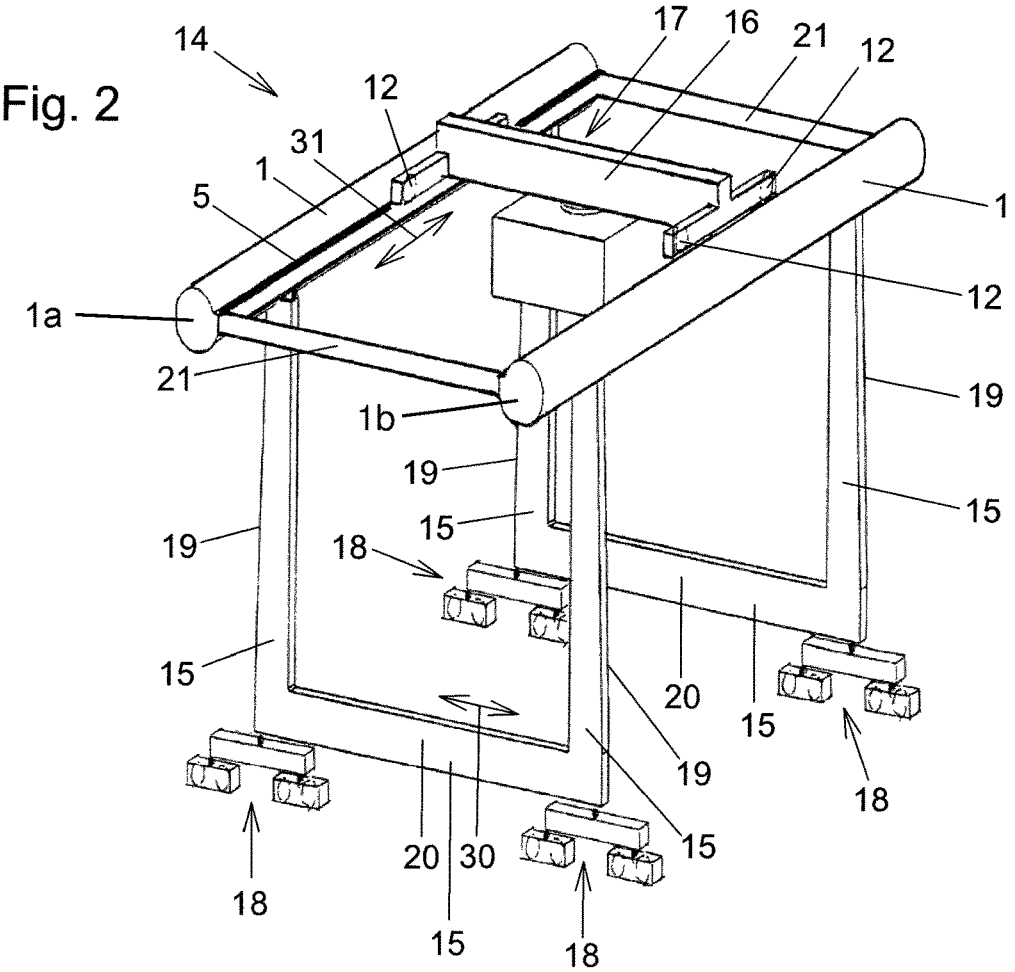
FIG. 2 shows an isometric view of a crane according to the invention with hollow profiles according to the invention.

FIG. 2 shows an example of a crane 14 according to the invention which is designed as a gantry crane and has a hoist 17 (illustrated in simplified form) for lifting a load, for example a container, with a position-variable trolley 16. The trolley 16 is supported on two crane girders of the crane 14 and is movable in mutually opposed movement directions 31. The crane girders could also be referred to as main girders of the crane 14 and are designed as hollow profiles 1 according to the invention. The respective hollow profile 1 is formed in a longitudinally extended manner. The trolley 16 has running wheels 12 which are supported on an add-on part 5 which is fastened to the respective hollow profile 1. In this application, the add-on part 5 has a running surface for the running wheels 12 and is designed as a running rail for the trolley 16. The two hollow profiles 1 of the crane 14 can be connected to each other at their end-side ends by horizontal connections 21, as is shown here. The substructure of the crane 14 consists of the supports 19 and horizontal connections 20 which connect the supports 19 to one another. The crane 14, in the exemplary embodiment shown, is movable by the chassis 18 of the crane 14 along a crane track (not illustrated) in mutually opposed directions of movement 30.

Figure 3:
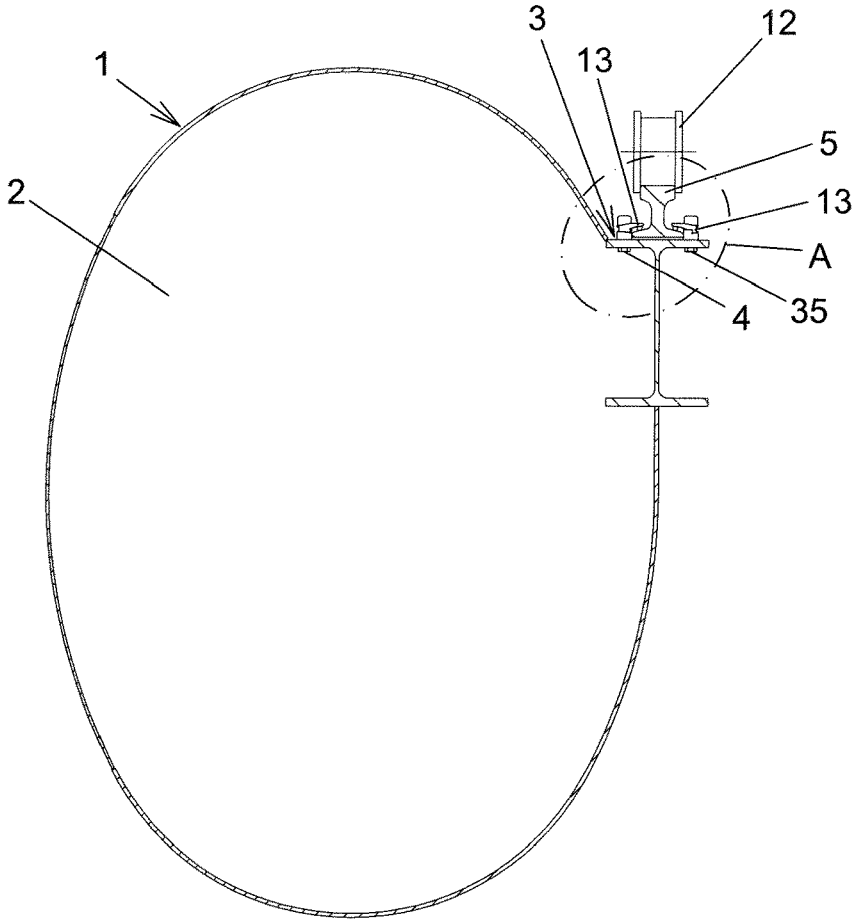
FIG. 3 shows a cross-sectional view of the main girder, which is designed as a hollow profile, of the crane according to FIG. 2.

FIG. 3 shows a cross-sectional view orthogonally to the longitudinal extent of the left of the hollow profiles 1 illustrated (=orthogonally to the opposed movement directions 31 of the trolley 16) according to FIG. 2. The hollow profile 1 has a cross section substantially similar to an ellipse. However, in other embodiments, the hollow profile 1 could also have a cross section differing from the elliptical form and could be comprised, for example, of rectilinear metal sheets.

An outer wall 3 of the hollow profile 1 bounds the cavity 2 of the hollow profile 1. In order to absorb the load introduced by the running wheel 12, the outer wall 3 of the hollow profile 1 has a rectilinear wall portion which is formed by an I beam. On the end sides 1*a*, 1*b* of the hollow profile 1, the hollow profile 1 is closed by end metal sheets which are shown in FIG. 2. Furthermore, no reinforcing bodies in the form of what are referred to as struts, etc. which may be necessary, depending on the forces being anticipated, in order to reinforce the hollow profile 1 are illustrated in the figures either.

The add-on part 5 which is designed as a running rail is supported on the upper flange of the I beam and is fastened to the hollow profile 1 with a multiplicity of fastening elements 4. A rail base 25 is additionally arranged between the running rail and the upper flange. The rail base 25 could be comprised, for example, of an elastic material, for example an elastomer.

Figure 6:
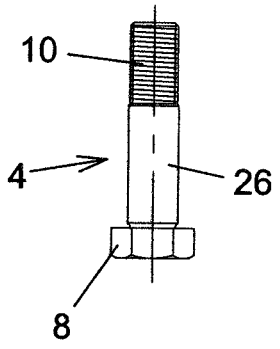
FIG. 6 shows an illustration of the fastening element according to the first exemplary embodiment of the invention.

In the first exemplary embodiment according to the invention, it is provided that the fastening element 4 is a shoulder bolt. Shoulder bolts have a threaded portion 10 and an adjoining smooth stem 26, wherein the stem 26 is located between the threaded portion 10 and a head 8 of the shoulder bolt. The diameter of the stem 26 is larger than the diameter of the threaded portion 10, also see FIG. 6.

The outer wall 3 of the hollow profile 1 has a passage opening 6, which opens into the cavity 2, for the fastening element 4. The passage opening 6 could be introduced, for example by drilling a through-hole into the upper flange of the I beam.

In the first exemplary embodiment, it is provided that the head 8 of the fastening element 4 designed as a shoulder bolt is supported on an inner surface 9 of the outer wall 3, said inner surface facing the cavity 2. The head 8 of the fastening element 4 is therefore arranged in the cavity 2 of the hollow profile 1. The head 8 has a larger diameter than the passage opening 6.

An intermediate space between a portion 36 of the outer wall 3, said portion bounding the passage opening 6, and the fastening element 4 is sealed according to the invention with a sealing compound 7. In the operating state of the hollow profile 1, the sealing compound 7 is preferably crosslinked or at least hardened. The sealing compound 7 adheres both to the fastening element 4 and to that portion 36 of the outer wall 3 which bounds the passage opening 6. The stem 26 or in general a thread-free region of the fastening element 4 is particularly preferably arranged in the passage opening 6. The penetration of fluid, in particular rain water, into the cavity 2 of the hollow profile 3 is prevented by the sealing compound 7.

In the first exemplary embodiment, it is provided that the sealing compound 7 is an adhesive. Due to the adhesion of the adhesive to the fastening element 4, preferably to the stem 26 thereof, and to that portion 36 of the outer wall 3 which bounds the passage opening 6, the fastening element 4 and the outer wall 3 are also fixedly connected to each other by the internal strength of the adhesive in the cured state of the adhesive.

The cured adhesive advantageously absorbs the entire counter torque for pretensioning the fastening element 4. This is particularly advantageous since the cavity 2 of the hollow profile 1 is advantageously completely sealed off from the atmosphere in the operating state. As a result, the head 8 is no longer accessible from outside the hollow profile 1 after the seal welding of the hollow profile 1. By use of a suitable adhesive, counter holding of the head 8 with a tool during the pretensioning or the installation of the add-on part 5 can therefore be dispensed with.

Figure 5:
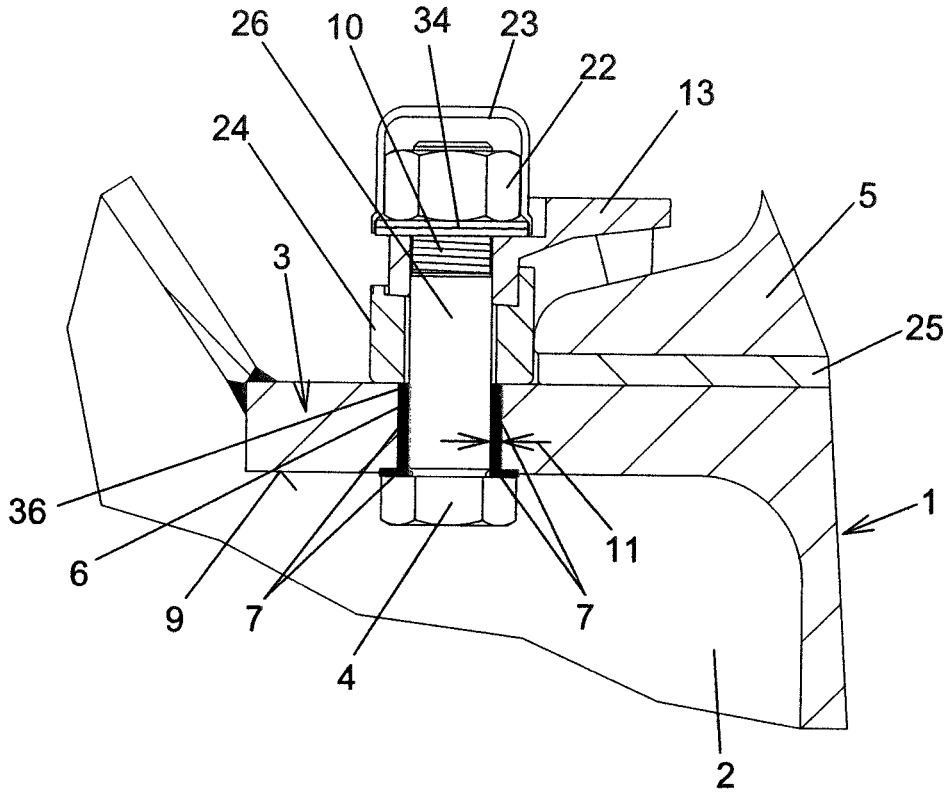
FIG. 5 shows the detail B according to FIG. 4.

In the first exemplary embodiment, it is provided that sealing compound 7 in the form of an adhesive is additionally arranged between the head 8 of the fastening element 4 and the inner surface 9 of the outer wall 3, see FIG. 5. As a result, the tightness is further improved and a higher counter torque for pretensioning the fastening element 4 is achieved.

The adhesive is preferably a high-strength adhesive, for example urethane methacrylate. It is particularly preferred that the adhesive cures anaerobically, i.e. that the hardening reaction takes place in the absence of oxygen (anaerobically) and in the presence of metal ions. An example of an anaerobically curing adhesive is Loctite® 648.

The intermediate space between that portion 36 of the outer wall 3 which bounds the passage opening 6 and the fastening element 4 is designed as an annular gap. That portion 36 of the outer wall 3 which bounds the passage opening 6 is preferably designed in the form of a circular cylinder jacket. The smooth stem 26 of the fastening element 4 designed as a shoulder bolt is located in the passage opening 6 in the operating state of the hollow profile 1. In the first exemplary embodiment, the annular gap is therefore of circular-cylindrical design. The gap width 11 of the annular gap is between 0.01 and 0.15 mm at least over the predominant part of the length of the annular gap. It is provided in the exemplary embodiment that the annular gap has a gap width 11 of 0.05 mm. As a result, reliable adhesive bonding of the fastening element 4 to the outer wall 3 of the hollow profile 1 can be ensured. The gap width 11 here is measured radially with respect to the direction of the longitudinal extent of the fastening element 4.

The sealing compound 7, in particular the adhesive, preferably completely fills the annular gap, as is illustrated in FIG. 5.

For the clamping of the add-on part 5, which is designed as a running rail, a rail clamp 13 which interacts with the respective fastening element 4 is furthermore provided in the exemplary embodiment shown. The running rail is clamped down in the operating state by a nut 22 which is screwed onto the threaded portion 10 of the shoulder bolt. The rail clamp 13 is supported here on one side on the rail foot of the running rail and on the other side on a clamp lower part 24, cf. FIG. 5. In the first exemplary embodiment, wedge securing disks 34 are arranged between the nut 22 and the rail clamp 13. The wedge securing disks 34 prevent independent unscrewing of the nut 22 during the operation of the crane 14.

Furthermore, in the first exemplary embodiment, the nut 22 is covered with a protective cap 23 which prevents moisture or liquid from penetrating between the thread turns of the nut 22 and the threaded portion 10 of the fastening element 4. The protective cap 23 can additionally be filled with grease in order to prevent water from penetrating the thread turns.

In order to fasten an add-on part 5, which is designed as a running rail, to a hollow profile 1 for a crane 14, correspondingly dimensioned fastening elements 4 are necessary for absorbing the typical loads. For this purpose, suitable shoulder bolts preferably have a metric thread of between M16 and M24 and more. In the first exemplary embodiment, the shoulder bolt has, for example, an M20 thread.

The fastening element 4 advantageously has a burnished, i.e. black, surface. However, it is also conceivable and possible for the surface of the fastening element 4 to be coated. For example, the fastening element 4 could also be formed with a zinc coating.

Figure 11:
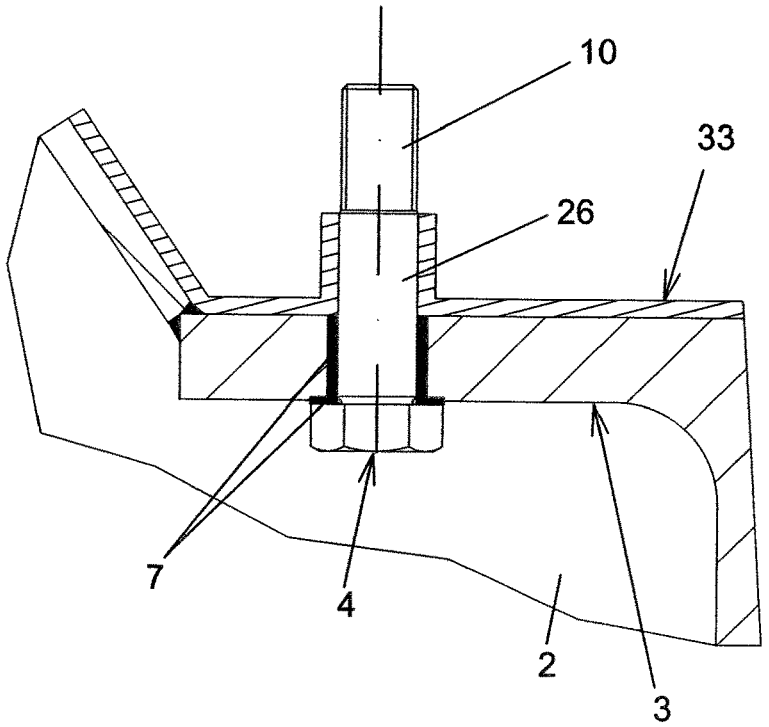
FIG. 11 shows a schematic illustration of an anti-corrosion layer in an illustration analogously to FIG. 5.

It is conceivable and possible for the hollow profile 1 and at least one portion of the fastening element 4, which protrudes from the outer wall 3, on the outer side of the hollow profile 1 to be coated with an anti-corrosion layer 33. These components are thereby protected against weathering influences or standing water. FIG. 11 shows an example of an outer anti-corrosion layer 33. The anti-corrosion layer 33 could be, for example, a paint composition, a zinc coating or the like which is applied to the hollow profile 1 and/or to the fastening element 4. In FIG. 11, the thickness of the anti-corrosion layer 33 is illustrated in exaggerated form in order to show the anti-corrosion layer 33. The fastening element 4 is covered by the anti-corrosion layer 33 in the region of that portion of the stem 26 which protrudes from the outer wall 3.

A method for fastening the add-on part 5, in particular the running rail according to the first exemplary embodiment, to the hollow profile 1 is described below. As already explained above, the passage openings 6 are drilled into the outer wall 3 of the hollow profile 1 in a preparatory stage. After the drilling, that portion 36 of the outer wall 3 which bounds the passage opening 6 is in each case in the form of a circular cylinder jacket. The sealing compound 7, in particular the adhesive, is then applied to that portion 36 of the outer wall 3 which bounds the respective passage opening 6. Sealing compound 7 is optionally also applied to that region of the inner surface 9 in which the head 8 of the fastening element 4 rests in the operating state of the hollow profile 1, as is the case in the first exemplary embodiment. In an alternative embodiment, the adhesive could instead also be applied to the fastening element 4. Some adhesives also require the adhesive to be applied to the two components to be joined. This substantially depends on the adhesive which is used.

Furthermore, the fastening elements 4 are introduced into the respective passage opening 6. In the exemplary embodiment, the fastening elements 4 are introduced during the production process of the hollow profile 1 in a method step in which the cavity 2 is still accessible, in order to plug the fastening element 4 from the cavity 2 through the passage opening 6. During the insertion of the fastening element 4, the threaded portion 10 is advantageously covered in order to prevent soiling of the threaded portion 10 with sealing compound 7 when guiding the fastening element 4 through the passage opening 6. After the insertion of the fastening element 4, the intermediate space between that portion of 36 of the outer wall 3 which bounds the passage opening 6 and the fastening element 4 is sealed with sealing compound 7, in particular the adhesive.

During the insertion of the fastening element 4, the hollow profile 1 can be placed upside down, i.e., after the insertion, the respective fastening element 4 rests with its head 8 on the inner surface 9 of the outer wall 3 and is pressed fully onto the inner surface 9 by the dead weight of the fastening element 4. The dead weight of the fastening element 4 is generally sufficient in order to ensure a secure adhesive bond between the fastening element 4 and the outer wall 3. However, it is also conceivable and possible for the fastening element 4 to be pretensioned, for example by a nut, while the sealing compound 7, for example the adhesive, cures. Furthermore, the fastening element 4 could also be driven into the passage opening 6 with a spring back-free hammer. The tightness can be verified by a tightness test.

After the sealing compound 7 has cured, an anti-corrosion layer 33, for example a protective coating, can be applied from the outside to the outer wall 3 and to a portion of the fastening element 4, which portion protrudes from the outer wall 3, as has already been explained in conjunction with FIG. 11. The threaded portion 10 of the fastening element 4 is advantageously covered during the application of the anti-corrosion layer 33. After the application of the anti-corrosion layer 33, this covering can be removed again from the fastening element 4.

After the curing and/or drying of the optional corrosion coating 33, the rail base 25 and the add-on part 5 can furthermore then be placed onto the hollow profile 1. After the clamp lower part 24 and the rail clamp 13 are pushed onto the fastening element 4, the rail clamp 15 is clamped down by tightening of the nut 22, in order to fasten the add-on part 5 to the hollow profile 1. Furthermore, the optional protective cap 23 can be pushed over the nut 22.

Figure 4:
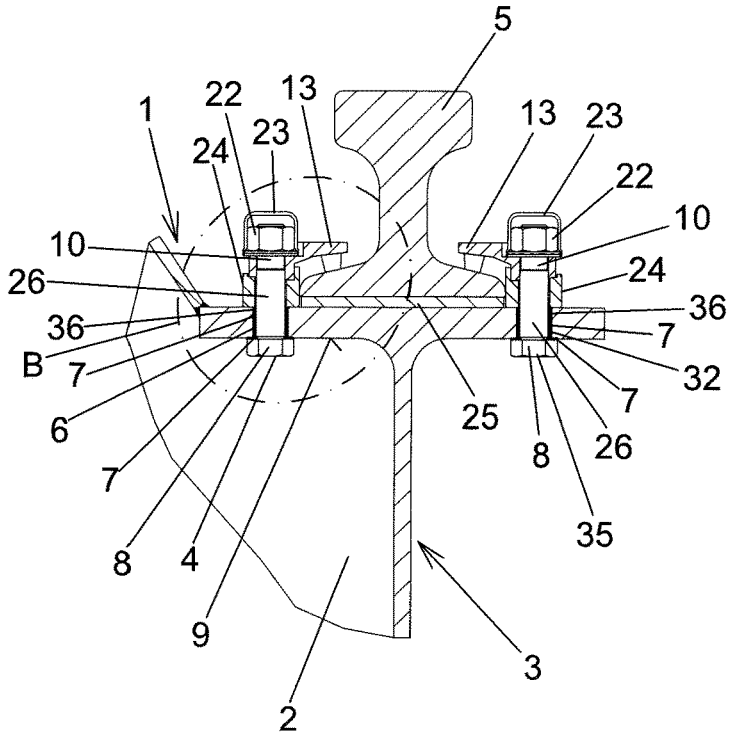
FIG. 4 shows the detail A according to FIG. 3 without a running wheel.

As can be seen in FIGS. 3 and 4, a fastening element 35 for the additional fastening of the add-on part 5 to the hollow profile 1 is provided in the region outside the cavity 2. In the first exemplary embodiment, the fastening element 35 is formed analogously to the fastening element 4. However, the head 8 of the fastening element 35 is accessible from the outside, i.e. the fastening element 35 is guided through a passage opening 32 which penetrates a portion 36 of the outer wall 3 of the hollow profile 1, which portion 36 is open toward the atmosphere on both sides, cf. FIG. 4. Otherwise, the fastening of the add-on part 5 by the fastening element 35 can take place analogously to the fastening element 4. The intermediate space between that portion 36 of the outer wall 3 which bounds the passage opening 32 and the fastening elements 35 can also be sealed here with a cross-linkable or crosslinked sealing compound 7, in particular adhesive. However, this sealing can also be omitted at this point.

Figure 7:
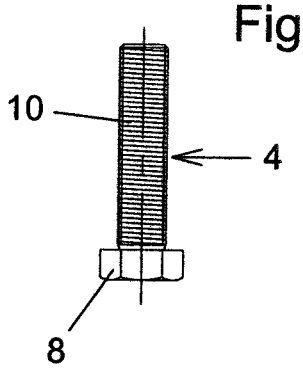
FIGS. 7 to 9 show examples of alternative variant embodiments of fastening elements.
Figure 8:
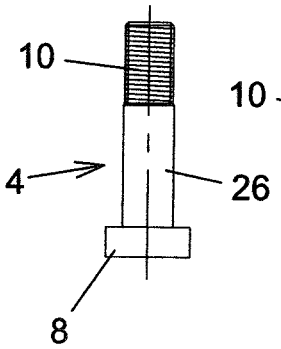
Figure 9:
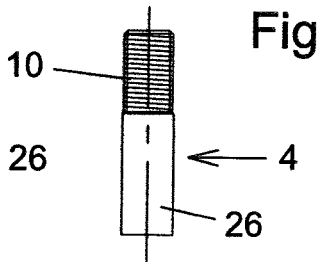

FIGS. 7 to 9 show alternative embodiments of suitable fastening elements 4. The fastening element 4 which is illustrated in FIG. 7 is designed as a screw which has a threaded portion 10 extending substantially as far as the head 8. The sealing between the outer wall 3 and the fastening element 4 then follows in a region of the threaded portion 10 that is adjacent to the head 8.

FIG. 8 shows a fastening element 4 designed as a bolt. The bolt has a head 8 and a threaded portion 10 for pretensioning the fastening element 4. In the mounted state, the stem 26 is located in the region of the passage opening 6, analogously to the first exemplary embodiment. Apart from the head 8, which is designed as a circular cylindrical head, the operating principle of the fastening element 4 according to this variant embodiment is similar to the shoulder bolt according to FIG. 6. In particular, it is also conceivable and possible for sealing compound 7 to be arranged in the region of the head 8 which, in the operating state, is supported on the inner surface 9 of the outer wall 3.

FIG. 9 shows a further fastening element 4 which is designed as a bolt. In contrast to the bolt illustrated in FIG. 8, the bolt according to FIG. 9 does not have a head. In particular when a bolt of this type is used, it is advantageous if the sealing compound 7 is an adhesive. The adhesive bonding then takes place on the lateral surface of the stem 26 of the bolt and then absorbs the counter torque for the fastening of the add-on part 5. The bolt according to FIG. 9 additionally has a threaded portion 10 which, analogously to the first exemplary embodiment, forms a screw connection, for example with a nut, for clamping down the rail clamp 13. In a further embodiment, such a bolt can also have a continuous thread on its entire lateral outer surface, i.e. can be designed in principle like the screw according to FIG. 7 only without the head 8.

Figure 10:
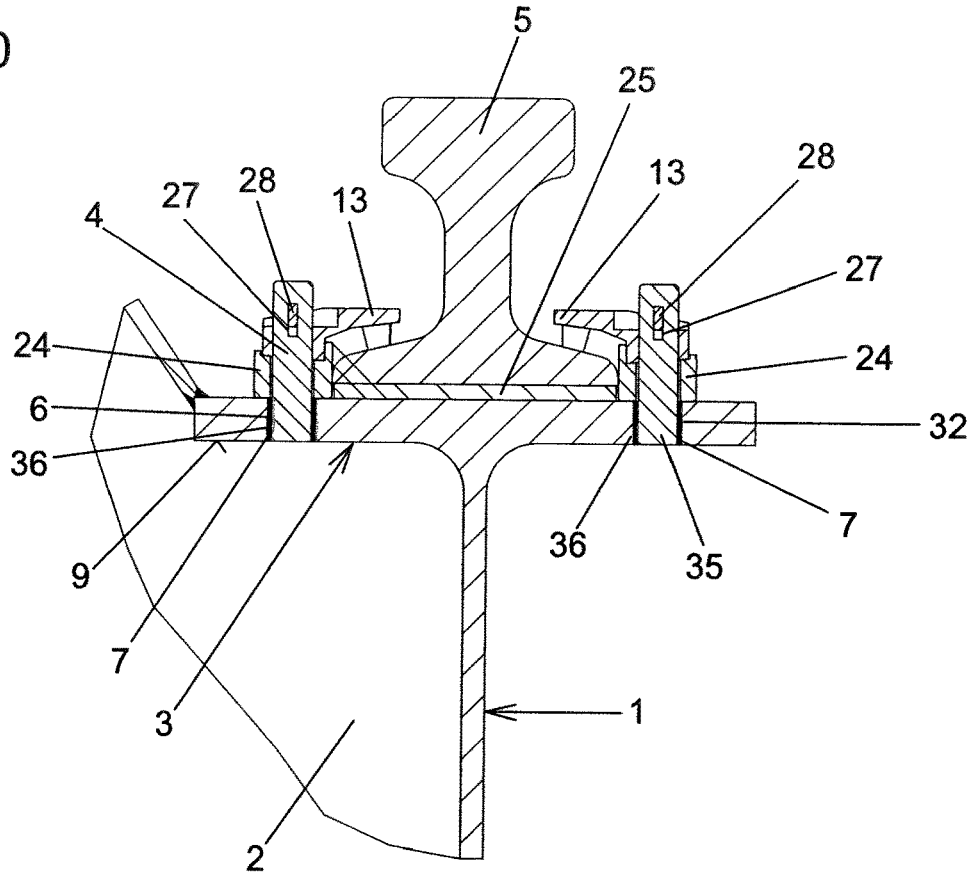
FIG. 10 shows a second exemplary embodiment of a hollow profile according to the invention in an illustration analogously to FIG. 4.

FIG. 10 illustrates a second exemplary embodiment of a hollow profile 1 according to the invention. The structural design of the hollow profile 1 and the arrangement of the add-on part 5, which is also designed here as a running rail for a trolley, corresponds to that of the first exemplar embodiment, and therefore, in the explanations regarding the second exemplary embodiment, reference is primarily made to the differences over the first exemplary embodiment. Apart from the differences listed below, the explanations regarding the first exemplary embodiment also apply in the case of the second exemplary embodiment.

In the second exemplary embodiment, it is provided that the fastening element 4 is designed as a bolt. The bolt has a rectangular opening 27 orthogonally to its longitudinal extent for the passage of a wedge 28. FIG. 10 shows a sectional illustration in which the wedge 28 is inserted into the opening 27. Arrangements of this type with a wedge 28 for bracing two components are known. The fastening element 4 is fastened at a cylinder casing surface of the bolt to the hollow profile 1 with sealing compound 7, in particular adhesive. The rail clamp 13 is clamped down by the wedge 28 being knocked in.

FIGS. 1 to 11 illustrate hollow profiles 1 which serve for fastening add-on parts 5 which are designed as a running rail. The crane 14 according to FIG. 2 also has, in addition to the hollow profiles 1, further crane girders in the manner of a hollow profile according to the invention. The supports 19 and the horizontal connections 20 are designed as hollow profiles 15 which can have fastening elements 4 (not illustrated) according to the invention. For example, ladders or other add-on parts 5 of the crane 14 could be fastened to the hollow profiles 15 by fastening elements arranged on the hollow profiles 15. Within the context of the invention, it is also advantageous in this connection if the respective cavity of the hollow profile 15 is completely separated from the surroundings.

Embodiments of the invention in which the sealing compound 7 is an adhesive are shown in the exemplary embodiments. However, it can also be provided that the sealing compound 7 substantially serves only for sealing the intermediate space between that portion 36 of the outer wall 3 which bounds the passage opening 6 and the fastening element 4 and has only a small fastening effect, if any at all. It should then be ensured that the counter torque for pre-tensioning the fastening element 4 is provided in another manner, for example by a form-fitting connection to the inner surface 9 of the outer wall 3, said form-fitting connection preventing rotation of the head 8 of the fastening element 4.

In a departure from the example of a crane 14 that is shown in FIG. 2, the crane could also have only a single main girder instead of two main girders, wherein a pair of running rails is then advantageously fastenable to the hollow profile 1 by a multiplicity of fastening elements 4.

KEY FOR THE REFERENCE NUMBERS

1 Hollow profile
2 Cavity
3 Outer wall
4 Fastening elements
5 Add-on part
6 Passage opening
7 Sealing compound
8 Head
9 Inner surface
10 Threaded portion
11 Gap width
12 Running wheel
13 Rail clamp
14 Crane
15 Hollow profile
16 Trolley
17 Hoist
18 Chassis
19 Support
20 Horizontal connection
21 Horizontal connection
22 Nut
23 Protective cap
24 Clamp lower part
25 Rail base
26 Stem
27 Opening
28 Wedge
29 Weld seam
30 Direction of movement
31 Movement direction
32 Passage opening
33 Anti-corrosion layer
34 Wedge securing disks
35 Fastening element
36 Portion

The invention claimed is:

1. A hollow profile comprising an outer wall that surrounds a cavity, at least one fastening element protruding from the outer wall for fastening of at least one add on part to the hollow profile, the outer wall has at least one passage opening, which opens into the cavity, for the fastening element, an intermediate space between a portion of the outer wall which bounds the passage opening and the fastening element which is guided through the passage opening, and a sealing compound that seals the intermediate space such that the cavity of the hollow profile is completely separated from atmosphere, and end sides of the hollow profile are closed by end metal sheets.

2. The hollow profile according to claim 1, wherein the fastening element has a head which is arranged in the cavity of the hollow profile and is supported on an inner surface of the outer wall, said inner surface facing the cavity.

3. The hollow profile according to claim 2, further comprising the sealing compound also being arranged between the head of the fastening element and the inner surface of the outer wall.

4. The hollow profile according to claim 1, wherein the sealing compound is an adhesive.

5. The hollow profile according to claim 1, wherein the fastening element is a threaded fastener.

6. The hollow profile according to claim 1, wherein the fastening element is a bolt.

7. The hollow profile according to claim 1, wherein the intermediate space between that portion of the outer wall which bounds the passage opening and the fastening element is an annular gap, and a gap width of the annular gap is between 0.01 mm and 0.15 mm at least over a majority of a length of the annular gap.

8. The hollow profile of claim 1, wherein the hollow profile is a crane girder.

9. The hollow profile according to claim 5, wherein the fastening element is a shoulder bolt.

10. The hollow profile according to claim 6, wherein the bolt has a threaded portion.

11. The hollow profile according to claim 7, wherein the gap width of the annular gap is between 0.02 mm and 0.1 mm at least over a majority of a length of the annular gap.

12. A crane comprising: a hollow profile including an outer wall that surrounds a cavity, at least one fastening element protruding from the outer wall for fastening of at least one add on part to the hollow profile, the outer wall has at least one passage opening, which opens into the cavity, for the fastening element, an intermediate space between a portion of the outer wall which bounds the passage opening and the fastening element which is guided through the passage opening, and a sealing compound that seals the intermediate space such that the cavity of the hollow profile is completely separated from atmosphere, and end sides of the hollow profile are closed by end metal sheets.

13. The crane according to claim 12, further comprising the at least one add on part, the add-on part comprising a running rail of the crane for at least one running wheel of a trolley of a hoist of the crane, and the hollow profile has a multiplicity of fastening elements, wherein, in an operating state, the running rail is fastened to the fastening elements.

14. The crane according to claim 12, wherein the crane is a gantry crane.

15. A method for fastening an add on part to a hollow profile, the method comprising:

providing a hollow profile including an outer wall that surrounds a cavity, at least one fastening element protruding from the outer wall for fastening of at least one add on part to the hollow profile, the outer wall has at least one passage opening, which opens into the cavity, for the fastening element, an intermediate space between a portion of the outer wall which bounds the passage opening and the fastening element which is guided through the passage opening, and a sealing compound that seals the intermediate space;

applying the sealing compound to at least one of a portion of the outer wall which bounds the passage opening or the fastening element, introducing the fastening element into the passage opening, sealing the intermediate space between the portion of the outer wall which bounds the passage opening and the fastening element with the sealing compound such that the cavity of the hollow profile is completely separated from atmosphere, and end sides of the hollow profile are closed by end metal sheets, and fastening the add on part to the hollow profile using the fastening element.

16. The method according to claim 15, wherein the add on part is fastened to the hollow profile after curing of the sealing compound.

17. The method according to claim 15, wherein the add-on part is a running rail.

18. The hollow profile according to claim 1, wherein the end metal sheets have a flat profile.

19. The crane according to claim 12, wherein the end metal sheets have a flat profile.

20. The method according to claim 15, wherein the end metal sheets have a flat profile.

* * * * *